United States Patent [19]

Varndell et al.

[11] Patent Number: 4,536,906

[45] Date of Patent: Aug. 27, 1985

[54] MATTRESS WITH APERTURED INSERT

[75] Inventors: Sydney A. Varndell, Andover; Douglas R. Lawson, Minster; Michael W. Fountain, Gillingham, all of England

[73] Assignee: Thomas Jourdan PLC, Windson, England

[21] Appl. No.: 489,386

[22] Filed: Apr. 28, 1983

[30] Foreign Application Priority Data

Jun. 8, 1982 [GB] United Kingdom ..... 8216656

[51] Int. Cl.[3] ..... A47C 27/14; A47D 7/00

[52] U.S. Cl. ..... 5/468; 5/462

[58] Field of Search ..... 5/465, 462, 463, 464, 5/435, 468, 420

[56] References Cited

U.S. PATENT DOCUMENTS

| | | | |
|---|---|---|---|
| 509,081 | 11/1893 | Harding | 5/463 |
| 1,517,617 | 12/1924 | Cleveland | 5/462 |
| 2,462,579 | 2/1949 | Warner | 5/462 |
| 3,142,812 | 3/1964 | Milton et al. | 5/435 |
| 3,451,071 | 6/1969 | Whiteley | 5/465 |
| 4,054,960 | 10/1977 | Pettit et al. | 5/462 |

FOREIGN PATENT DOCUMENTS

| | | | |
|---|---|---|---|
| 2949282 | 6/1981 | Fed. Rep. of Germany | 5/435 |
| 1464593 | 1/1967 | France | 5/465 |
| 1139357 | 1/1969 | United Kingdom | 5/435 |
| 1545325 | 5/1979 | United Kingdom | 5/455 |

*Primary Examiner*—Alexander Grosz

*Attorney, Agent, or Firm*—Cushman, Darby & Cushman

[57] ABSTRACT

A mattress for small children has a removable foam insert which fits in an aperture cut in the head portion of a foam mattress body. The insert has a plurality of perforations extending from its top face to its bottom face which reduce the risk of suffocation, the perforations being grouped towards the head of the mattress for optimum positioning beneath the child's head. To ensure that a replacement insert, when the former insert is soiled and requires washing, is fitted in the correct orientation, each insert has a key portion projecting from one edge for interlocking with a correspondingly shaped recess in a side wall of the aperture.

5 Claims, 4 Drawing Figures

MATTRESS WITH APERTURED INSERT

BACKGROUND OF THE INVENTION

This invention relates to a mattress, and primarily to a cot mattress having perforations to reduce the danger of suffocation.

Such a mattress is known and has been manufactured for many years. The known mattress is rectangular in shape, made of foam material and has perforations extending through the head portion from the top surface to the bottom surface to provide for passage of air should the baby bury its face in the mattress. A ventilated cover is provided for the head portion and a waterproof cover fits over the rest of the mattress.

One difficulty with the known mattress is that it is not easy to wash should for example the baby vomit while lying on the mattress. In particular the difficulty of cleaning inside the perforations annd subsequently drying the mattress is considerable and especially inconvenient if it is night time.

SUMMARY OF THE INVENTION

In accordance with this invention the mattress is provided with a removable insert in the head portion. The insert is preferably of the same thickness as the body of the mattress and fits in an aperture in the head portion so that its top surface lies flush with the top surface of the mattress. The size and shape of the insert corresponds generally to the area likely to be affected should the baby vomit, and the perforations referred to above are produced in the insert itself. The perforations may be positioned asymmetrically in the insert, in which case it is preferable to provide a key portion shaped to fit in a recess on one side of the aperture so that the insert is always replaced in the correct orientation, with the perforations correctly positioned.

The mattress in accordance with the invention has the advantage that a soiled insert can be quickly and easily removed, and can be replaced by a spare dry insert. Compared to the mattress as a whole the insert is relatively small in size so that it can more easily be washed and spin-dried in a domestic washing machine.

The ability to replace the insert quickly and easily has the additional advantage of largely avoiding the temptation merely to wipe the top surface of the mattress, possibly leaving the perforations soiled, or worse, blocked.

In the preferred embodiment of the invention, movement of the insert at its boundary relative to the surrounding main body of the mattress when the baby rolls towards the side of the mattress tends to prevent further rolling movement, so keeping the baby's head within the protected area.

A further feature of the preferred embodiment is that the insert is directed into two separate layers having the same outline. This tends to reduce the possibility of shape distortion during manufacture, and can assist in preventing the rolling movement referred to above.

DESCRIPTION OF DRAWINGS

The invention is illustrated by way of example in the accompanying drawings in which.

DETAILED DESCRIPTION OF THE PREFERRED EMBODIMENT

Figure 1:
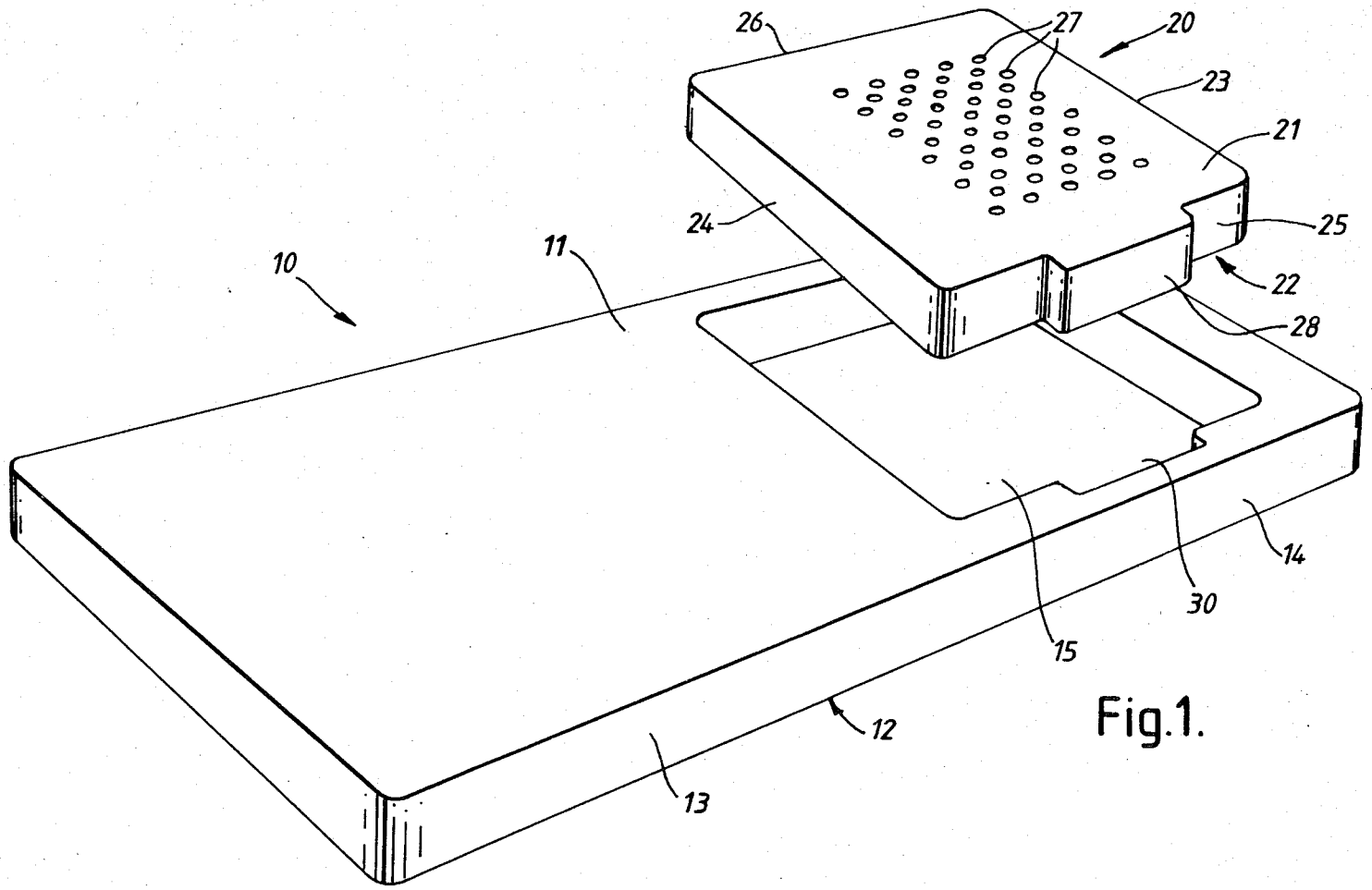
FIG. 1 is an exploded perspective view of a mattress in accordance with the invention.

Referring to FIG. 1, a first embodiment of the invention has a single layer mattress body 10 cut from a porous, resilient fire-retardant foam plastics material. The body 10 has a top surface 11 and a bottom surface 12 which, in this embodiment, are interchangeable in that the surface 12 could be used as a lying surface. It has a main portion 13 for supporting a child's body and a head portion 14 with an aperture 15 opening out on the top surface 11 and extending to the bottom surface 12 with a constant rectangular outline.

In use of the mattress the aperture 15 accommodates a generally rectangular removable and replaceable foam insert 20 having a top face 21 normally flush with the top surface 11, a bottom face 22 normally flush with the bottom surface 12, an upper edge 23, a lower edge 24, and shorter side edges 25 and 26. The aperture 15 is located in the head portion of the mattress body 10 so that the child's head is positioned over the insert 20, perforations 27 being provided in the insert extending from the top face 21 to the bottom face 22 to allow passage of air through the insert should the child bury its face in the mattress, so reducing the danger of suffocation.

For optimum positioning beneath the child's head, the perforations 27 are grouped together within a perforated area which asymmetrically located in the insert and is nearer the top edge 23 of the insert than the lower edge 24. In order that the perforations 27 are correctly positioned when the insert 20 is replaced, means are provided for ensuring that the insert 20 can only be fitted into the aperture 15 in one orientation, such means in this embodiment being a key portion 28 projecting from the side edge 25 of the insert 20 for co-operation with a correspondingly shaped recess 30 cut in the corresponding side wall of the aperture 15. The key portion 28 is asymmetrically located in the side edge 25.

If, in use, the insert 20 becomes soiled, it can be quickly removed and a clean replacement insert fitted so that the child has a clean, dry mattress with the minimum delay, the original insert being washed later. The size of the insert is such that washing is comparatively easier than washing the complete mattress as has been necessary with prior art cot mattresses.

Figure 2:
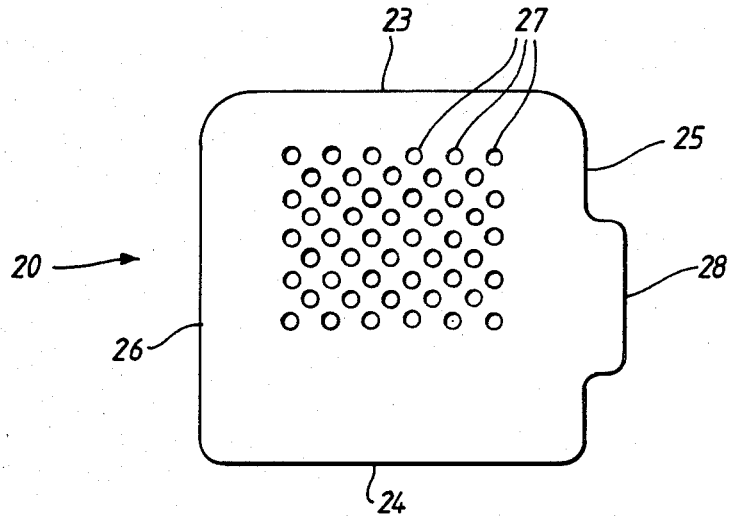
FIG. 2 is a plan view of a removable insert.

The insert 20 is shown in plan in FIG. 2.

Figure 3:
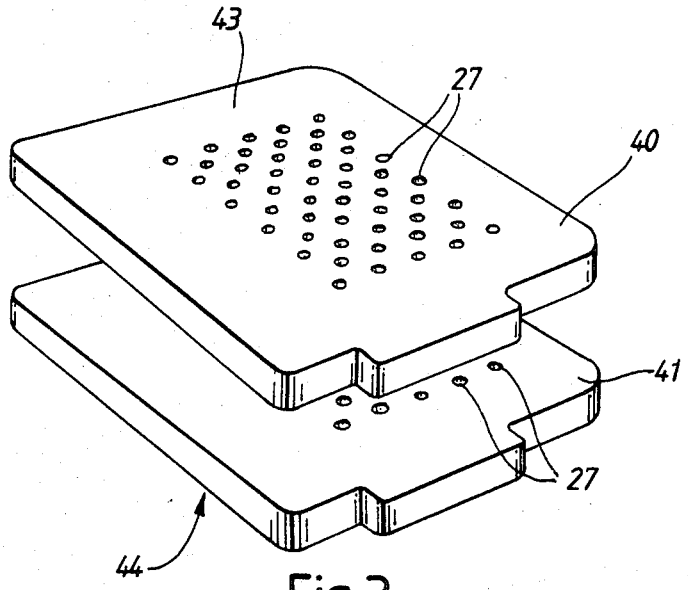
FIG. 3 is a perspective view of an alternative, two-layer insert.

Referring to FIG. 3, an alternative insert comprises two identical insert parts 40 and 41, each having an outline corresponding to the shape of the aperture 15, and having correspondingly cut perforations 27. The insert parts 40 and 41 are half the thickness of the mattress body 10 so that when fitted together in abutting relationship in the aperture 15, the top face 43 of the upper part 40 lies flush with the top surface 11 of the mattress body 10, and the bottom face 44 of the bottom part 41 is flush with the bottom surface 12.

Figure 4:
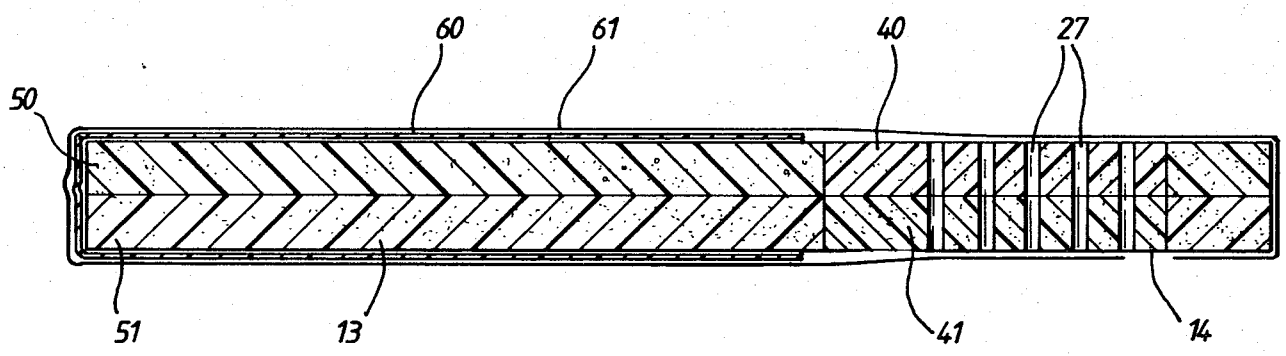
FIG. 4 is a longitudinal section of a second mattress in accordance with the invention.

The mattress body 10 may also be formed from two half-thickness parts 50 and 51, as shown in FIG. 4.

It is important that any covers used for the head portion 14 of the mattress should be air-permeable to allow air passage to the perforations 27. In the embodiment shown in FIG. 4, the main portion 13 of the mattress body is covered by a waterproof fire-retardent PVC sleeve 60, and a full length air-permeable cellular polyester sheet 61 is fitted over the sleeve 60 and the head portion 14. Preferably, this sheet 61 completely encloses the mattress body 10 and is shaped correspondingly to restrict movement relative to the mattress body and to provide a crease-free surface for the child to lie on.

What is claimed is:

1. A mattress comprising:

a foam mattress body with a main portion and a head portion, and a top surface and a bottom surface; and a removable foam insert having a top face and a bottom face, and, distributed in a predetermined region thereof, a plurality of perforations each extending from the top face through to the bottom face;

the mattress body having an aperture in the head portion for receiving the insert, which aperture opens out on the top surface, extends from the top surface to the bottom surface of the mattress body and has a continuous perimeter shaped to correspond generally to the outline of the insert;

the thickness of the insert being such that the top face thereof lies substantially flush with the top surface of the mattress body, and the arrangement of the perforations providing air passages communicating with the underside of the mattress for ventilation of the top face of the insert, the perforations being grouped asymmetrically relative to the outline of the insert, and the insert and the aperture being so correspondingly shaped that the insert can only be fitted in a required orientation, the insert being generally rectangular, and having a key portion projecting from one side, the aperture having a correspondingly shaped recess for receiving the key portion.

2. A mattress according to claim 1, wherein the key portion is asymmetrically located on one of the shorter sides of the rectangular insert.

3. A mattress according to claim 1 wherein the perforations are distributed within a peforated area of the top face of the insert, the said area being generally nearer one of the longer sides of the rectangular insert than the other longer side thereof.

4. A mattress according to claim 1, wherein the insert comprises at least two separable insert parts each corresponding in shape to the shape of the aperture, the total of the thicknesses of the insert parts being approximately equal to the thickness of the mattress body.

5. A mattress according to claim 1, including a waterproof cover fitted over the main portion of the mattress body, and an air-and liquid-permeable cover enclosing the mattress body and insert.

* * * * *